United States Patent [19]

Evans

[11] 3,933,395

[45] Jan. 20, 1976

[54] STABILIZER

[75] Inventor: Ernest G. Evans, Lafayette, La.

[73] Assignee: Reamco, Inc., Lafayette, La.

[22] Filed: Dec. 13, 1973

[21] Appl. No.: 424,617

[52] U.S. Cl. ..... 308/4 A

[51] Int. Cl.[2] ..... F16C 17/00

[58] Field of Search ..... 308/4 R, 4 A

[56] References Cited

UNITED STATES PATENTS

| | | | |
|---|---|---|---|
| 1,810,948 | 6/1931 | Dorn | 308/4 A |
| 1,880,269 | 10/1932 | Murray | 308/4 A |
| 1,889,866 | 12/1932 | Montgonery | 308/4 A |
| 2,262,211 | 11/1941 | Stone | 308/4 A |
| 2,299,978 | 10/1942 | Hall | 308/4 A |
| 3,322,217 | 5/1967 | Cook | 308/4 A |
| 3,330,359 | 7/1967 | Ward | 308/4 A |
| 3,360,846 | 1/1968 | Schellstede et al. | 308/4 A |
| 3,420,323 | 1/1969 | Owens | 308/4 A |
| 3,747,700 | 7/1973 | Rilling | 308/4 A |

FOREIGN PATENTS OR APPLICATIONS

| | | | |
|---|---|---|---|
| 34,763 | 2/1935 | Netherlands | 308/4 A |
| 611,887 | 11/1948 | United Kingdom | 308/4 A |

*Primary Examiner*—Charles J. Myhre
*Assistant Examiner*—R. H. Lazarus
*Attorney, Agent, or Firm*—Jack W. Hayden

[57] ABSTRACT

A stabilizer for a tubular string includes a tubular body with a sleeve split transversely which forms two portions that fit on the body with means for securing the split sleeve on the body.

14 Claims, 3 Drawing Figures

STABILIZER

SUMMARY OF THE INVENTION

Various types stabilizers have been proposed and are in use at the present time in tubular strings such as by way of example only, drill strings, sucker rods and the like. Those stabilizers with which applicant is familiar include radially projecting bearing surfaces formed on a tubular body or formed on a sleeve carried on a tubular body. Such arrangements as known to applicant include either a body or mandrel which is split transversely which is threadedly connected together along with a one piece sleeve to form the stabilizer, which may require that one portion of the mandrel be reduced in diameter for receiving the sleeve thereon.

In other forms of stabilizers, the sleeve is split longitudinally and then secured on the tubular body, while in other forms of stabilizers the sleeve may be shrunk fit on the tubular body or positioned thereon by other means.

Some references with which applicant is familiar include those to Salvatori U.S. Pat. No. 3,447,839; Cook U.S. Pat. No. 3,322,217; Smith U.S. Pat No. 1,716,247; Swart U.S. Pat. No. 2,813,697; Ortloff et al, U.S. Pat. No. 3,268,274; and Sandstone U.S. Pat. No. 2,352,412.

Under some conditions, it is not uncommon for one portion, such as by way of example only, the lower portion of a stabilizer, when it is employed in a drill string, to be more subject to wear than another portion, such as the upper portion. Thus, when the lower portion becomes sufficiently worn, it is necessary to replace the entire stabilizer, the difficulty of renewing or replacing such worn stabilizer depending upon the type employed.

The present invention provides a stabilizer wherein substantially the same outer diameter is provided throughout the longitudinal extent of tubular body on which the stabilizer is carried so as to inhibit stress areas in the mandrel during drilling operations.

Another object of the present invention is to provide a stabilizer including a tubular body, a sleeve split transversely to form two sleeve portions for fitting on the body and means for securing the split sleeve portions on the body.

Another object of the present invention is to provide a stabilizer including a tubular body, a sleeve split transversely to form two sleeve portions for fitting on the body and means for securing the split sleeve portions on the body whereby when one portion of the stabilizer wears more than the other, it is only necessary to replace that portion of the stabilizer which is worn.

Still another object of the present invention is to provide a method of forming a stabilizer on a cylindrical member by forming right hand threads on the member intermediate the ends thereof, forming left hand threads on the member adjacent the right hand threads and threading sleeves on each the left and right hand threads of the member until the sleeves abut.

Still another object of the present invention is to provide a method of forming a stabilizer on a cylindrical member by forming right hand threads on the member intermediate the ends thereof, forming left hand threads on the member adjacent the right hand threads and threading sleeves on each the left and right hand threads of the member until the sleeves abut and locking the sleeves on the cylindrical member.

Still another object of the present invention is to provide a stabilizer of relatively simple construction which overcomes the problems of stabilizers presently in use and known to applicant, and which is constructed so that even though it employs a sleeve which is split transversely, it will tend to retain its position and not become loosened when it is used in drilling operations.

Yet a further object of the present invention is to provide a stabilizer having radially extending bearing surfaces thereon and including a sleeve that is split transversely so that it may be readily and quickly positioned on a tubular member such as a sucker rod, drill string, casing and the like.

Still another object of the present invention is to provide a stabilizer for a tubular member which can be replaced with a minimum of effort.

Other objects and advantages of the present invention will become more readily apparent from a consideration of the following description and drawings.

A further object of the invention is to provide a stabilizer including a mandrel, a sleeve split transversely for positioning on the mandrel and means for receiving the split sleeve on the mandrel and wherein said sleeve is curved longitudinally on its outer surface and provides a bearing surface thereon.

BRIEF DESCRIPTION OF THE PREFERRED EMBODIMENT

The present invention will be described in detail with regard to a specific application in connection with a tubular member having a longitudinal bore therein, such as a drill string member; however, it can be appreciated that the present invention may be employed in any tubular string such as tubing, casing, sucker rod and the like when desired.

Figure 1:
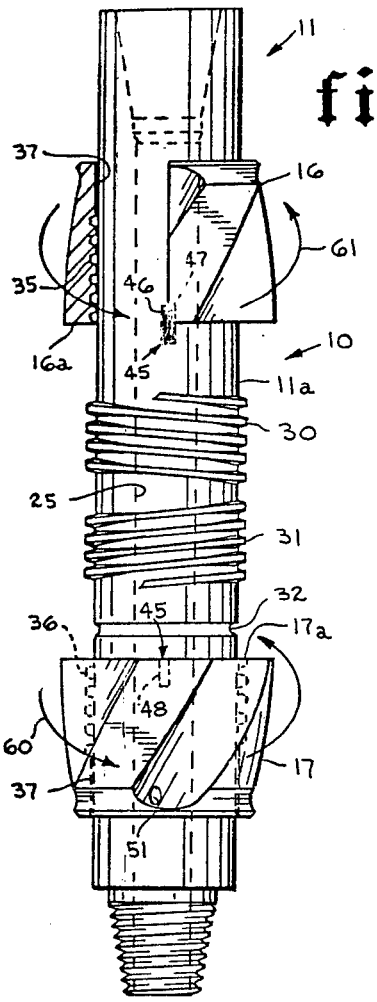
FIG. 1 is a side elevation of the preferred embodiment of the present invention, partly in section illustrating the tubular member and the sleeve which is split transversely for positioning on the tubular member.
Figure 2:
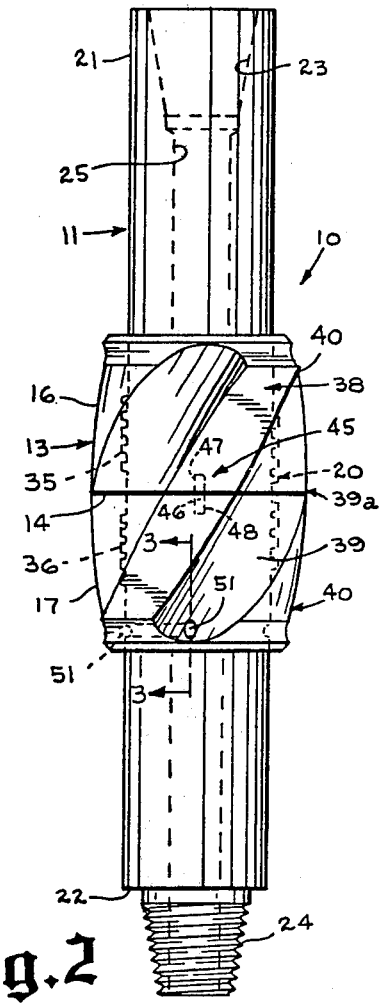
FIG. 2 is a side elvation illustrating the preferred embodiment of the present invention with the transverse split sleeve in final assembled relationship on the tubular member with the portions of such sleeve formed by the transverse split in abutting relationship.

Attention is first directed to FIGS. 1 and 2 wherein the stabilizer for a tubular string is illustrated generally by the numeral 10 and is shown as including a tubular body referred to generally at 11. A sleeve is referred to generally at 13 in FIG. 2 and is split transversely as shown at 14 to form sleeve portions 16 and 17. Means referred to generally at 20 are provided for securing the split sleeve 13 in position on the tubular body 11.

The form of the tubular body 11 as illustrated includes means at each end 21 and 22 for securing the tubular body in a tubular string. Such means is illustrated as including a longitudinally extending, tapered, threaded recess 23 at the end 21 which is normally termed a box, and longitudinally extending, tapered, threaded portion 24 at the other end normally termed a pin. In addition, the tubular body 11 is shown as including a longitudinal bore 25 extending through the tubular body 11 for fluid communication therethrough.

The body 11 is of substantially uniform outer diameter from the end 21 to the end 22 thereof and includes on its outer surface left hand threads 30 with right hand threads 31 also being formed on the outer surface 11*a* of the body adjacent the threads 30. In the form of the invention illustrated, the left hand threads 30 are positioned on the body 11 in closer relationship to the threaded box 23 than the right hand threads 31 which are in turn closer to the threaded pin in 24 than the left hand threads 30 as shown in FIGS. 1 and 2 of the drawings.

A circumferentially extending groove 32 is provided in the tubular body 11 for purposes as will be described.

The sleeve portions 16 and 17 of the sleeve 13 each include conforming left hand threads 35 and 36 formed on the surface 37 of the interior of each hollow sleeve portion 16 and 17. The threads 35 and 36 extend from each end 16*a* and 17*a* respectively of the sleeve portion 16 and 17 and extend a suitable, desired distance toward the other end of each sleeve portion.

As previously noted, the present invention is, for purposes of illustration only, described in configuration for use in a drill string, and it can be appreciated that the form and arrangement of the securing means may be varied as described.

The sleeve 13 also includes radially extending bearing surfaces referred to generally at 38 which are shown as inclined relative to the longitudinal axis of the sleeve member 13 and are circumferentially spaced by recesses 39 formed in the sleeve 13. The radial extent of the bearing surfaces 38 is such that it will engage an adjacently positioned surface such as the wall of a well bore, or where the invention may be employed in a sucker rod or other type tubular string, the stabilizer may engage a surrounding tubular member.

It will be further noted that in the form of the invention illustrated, the sleeve 13 is generally arcuate in configuration from one end to the other so that the central portion referred to generally at 39*a* in FIG. 2 projects radially outward to a greater extent than the portions 40 at each end of the bearing means 38. Thus, the outer surface is convex in configuration with respect to the longitudinal axis of sleeve 13.

As illustrated in the drawings the individual radially extending bearing surfaces 38 are integrally formed on the sleeve; however, in some circumstances such surfaces may be formed separate from the sleeve and then secured in position thereon by welding or other suitable means.

Cooperating means referred to generally at 45 are provided to interconnect the sleeve portions 16 and 17 when they are in assembled relationship on the tubular body 11 and as illustrated such cooperating means 45 is shown as including the pin 46 positioned in the opening 47 in the end 16*a* of one of the sleeve portions 16 and a conforming opening 48 extending longitudinally of and from the end 17*a* of the other sleeve portion 17.

Figure 3:
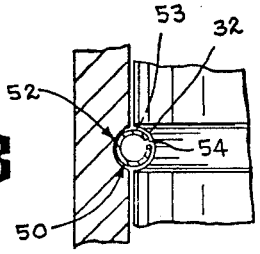
FIG. 3 is an enlarged partial sectional view on the line 3—3 of FIG. 2 illustrating one form of locking means which may be employed with a stabilizer.

In addition, suitable locking means referred to generally at 50 in FIG. 3 are provided for locking the sleeve 13 on the tubular body 11. Such securing or lock means 50 includes the circumferential groove 32 formed in the outer surface of the tubular body 11 and an opening 51 in at least one of the sleeve portions such as the sleeve portion 17 as shown.

When the sleeve portions 16 and 17 are in final assembled relationship on the tubular body 11 as illustrated in FIG. 2 of the drawings, the opening 51 aligns with the groove 32 to enable the pin means to be inserted therein. As illustrated, the form of the pin means 52 is shown as constituting a hollow cylindrical member 53 which is provided with a slot 54 extending longitudinally thereof. In addition, the hollow cylindrical member 53 may be of a slightly larger outer diameter than the diameter of the opening 51 so that when it is positioned in the opening and forced thereinto, it will snuggly fit therein and within the groove 32 to aid in assuring proper retention of the sleeve 13 on the tubular member 11 during use. Also, if desired the hollow cylindrical member 53 may be formed of suitable material so that it will tend to contract when forced into the smaller diameter opening 51, but by reason of its physical characteristics, it will continually tend to expand so as to form the snug fit hereinabove referred to.

To assemble the sleeve means 13 on the tubular body 11, each sleeve portion 16 and 17 is slipped over an end of the tubular member 11 and engaged with its respective threaded surface. Rotation of the sleeve portion 16 and 17 moves them towards each other and as they move toward each other, the pin means 46 may be aligned with the opening 48. When the end of the pin 46 is engaged within the end of the opening 48, the sleeve portions 16 and 17 may be rotated simultaneously until their ends 16*a* and 17*a* abut as shown in FIG. 2 of the drawings.

Thereupon the pin means 52 may be inserted in the opening 51 and forced therein and into groove 32 by any suitable means.

Where the present invention is to be employed in a tubular string such as a drill string in a well bore so that the inclined, radially extending bearing surfaces 38 engage an adajcent well bore, such bearing surfaces 38 will be of a suitable radial extent to engage the well bore as previously noted. In some circumstances, it has been found that the lower portion of the sleeve 13 will wear more quickly than the upper portion thereof as the tubular string in which the body 11 is positioned during drilling operations.

With stabilizer arrangements heretofore used, it has been necessary to replace the entire stabilizer sleeve 13, and the configuration and arrangement of such stabilizer arrangement on the tubular body 13 at least in some instances has required complete disassembly of the body 11 so that the sleeve 13 could be replaced, or such prior art devices have encountered other objections such as severe variations in the outer diameter of the tubular member to provide an engaging means for the sleeve means 13, which severe diameter changes in turn has provided areas or portions in the tubular body 11 more subject to stress concentration than other portion during rotation of the body 11 along with the tubular string in which it is connected in drilling operations.

The presented invention overcomes this and other disadvantages presently encountered with stabilizer arrangements in that either portion 16 or 17 may be readily replaced merely by disengaging the pin means 52, that is by withdrawing or driving the pin 52 out of the opening 51 whereupon the sleeve 13 may be rotated in a direction reversed to that indicated by the arrows 60 and 61 in FIG. 1 to separate the two portions 16 and 17 and to enable either or both of the sleeve portions which have become worn to be quickly and easily replaced.

It can also be appreciated that the present invention enables the stabilizer arrangement to be readily formed merely by forming a left hand threaded surface 30 on the outer surface of the body 11 and thereafter forming a right hand surface 31 adjacent the left hand surface 30.

Each sleeve portion 16 and 17 may then be positioned over the end of the tubular member and since each respective sleeve portion 16 and 17 include left and right hand threads 35 and 36 for engaging with the left and right hand threads 30 and 31 such sleeve portions upon rotation will move towards each other, and as previously noted when the pin 46 engages in the end of the opening 48, the two sleeve portions 16 and 17 may be rotated simultaneously in the same direction into abutting relationship.

Since the left hand threaded surface 30 and right hand surface 31 are positioned on the tubular body in relation to the pin and box ends 23 and 24 as shown, rotation of the tubular string in which the present invention is employed during normal drilling operations will tend to continually urge the sleeve portion 16 and 17 into abutting relationship. Should some emergency require slight or some rotation of the tubular string in an opposite direction, the locking or securing means 52 prevents separation of the sleeves 16 and 17 from each other.

The foregoing disclosure and description of the invention are illustrative and explanatory thereof, and various changes in the size, shape, and materials as well as in the details of the illustrated construction may be made without departing from the spirit of the invention.

What is claimed is:

1. A stabilizer for a tubular string including:

a. a tubular body;

b. sleeve means split transversely to form two sleeve portions for fitting on said body;

c. means for securing said split sleeve means on said body; and d. said securing means including left and right hand threads on said body and conforming left hand threads on one sleeve portion and right hand threads on the other sleeve portion whereby rotation of said sleeve portions on said body positions said sleeve portions in end to end abutting relationship on said body.

2. The invention of claim 1 wherein said sleeve portions each include radially extending bearing surfaces thereon.

3. The invention of claim 2 including cooperating means to align said radially extending surfaces in end to end abutting relationship when said split sleeve is secured on said body.

4. The invention of claim 3 wherein said cooperating means includes means on each of said sleeve portions engageable to interconnect said sleeve portions.

5. The invention of claim 2 wherein said radially extending bearing surfaces are integrally formed on said sleeve portions.

6. The invention of claim 4 wherein said cooperating means includes pin means projecting from one of said sleeve portions and an opening in the other of said sleeve portions for receiving said pin means.

7. The invention of claim 1 wherein said securing means includes cooperating means between at least one of said sleeve portions and said body to retain said split sleeve in position on said body.

8. The invention of claim 7 wherein said cooperating means includes a circumferentially extending groove on said body, a transverse opening in said one sleeve portion, and pin means for positioning in the opening and groove.

9. The invention of claim 8 wherein said pin means of said cooperating means is hollow and split longitudinally and is larger than the opening in said one sleeve whereby said pin means fits snugly in the opening.

10. The invention of claim 1 wherein said body is provided with threaded means for securing each end thereof in the tubular string.

11. The invention of claim 1 wherein said body is provided with a threaded box at one end and a threaded pin at the other end for securing said body in the tubular string.

12. The invention of claim 1 wherein said body is provided with a longitudinal bore therethrough.

13. The invention of claim 11 wherein said body is provided with a longitudinal bore therethrough.

14. The invention of claim 1 wherein said body is provided with a threaded box at one end and a threaded pin at the other end for securing said body in the tubular string and wherein said securing means includes left and right hand threads on said body and conforming right and left hand threads on said sleeve portions whereby said sleeve portions may be positioned in end to end abutting relationship on said body, said left hand threads on said body being positioned on said body at a position closer to said threaded box than said right hand threads on said body.

* * * * *